US009422928B2

(12) United States Patent
Ventrapragada

(10) Patent No.: US 9,422,928 B2
(45) Date of Patent: Aug. 23, 2016

(54) ELECTRIC MOTOR THERMAL ENERGY ISOLATION

(75) Inventor: Varaprasad Ventrapragada, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 423 days.

(21) Appl. No.: 13/817,481

(22) PCT Filed: Aug. 22, 2011

(86) PCT No.: PCT/IB2011/053679
§ 371 (c)(1),
(2), (4) Date: Feb. 18, 2013

(87) PCT Pub. No.: WO2012/025871
PCT Pub. Date: Mar. 1, 2012

(65) Prior Publication Data

US 2013/0142683 A1 Jun. 6, 2013

Related U.S. Application Data

(60) Provisional application No. 61/377,607, filed on Aug. 27, 2010.

(51) Int. Cl.

| | |
|---|---|
| ***F04B 35/04*** | (2006.01) |
| ***F04B 39/12*** | (2006.01) |
| ***F04B 35/00*** | (2006.01) |
| ***F04B 27/00*** | (2006.01) |
| ***F04B 53/08*** | (2006.01) |

(52) U.S. Cl.
CPC ..... *F04B 35/004* (2013.01); *F04B 27/005* (2013.01); *F04B 35/04* (2013.01);

(Continued)

(58) Field of Classification Search
CPC ..... F04B 35/04; F04B 39/066; F04B 39/12; F04B 39/121; F04B 39/128; F04B 27/02; F04B 27/005
USPC ..... 417/415, 529, 539
See application file for complete search history.

(56) References Cited

U.S. PATENT DOCUMENTS 2,167,879 A * 8/1939 Des Roches ..... F25B 31/00 417/281
4,540,382 A * 9/1985 Wilson ..... 464/73

(Continued)

FOREIGN PATENT DOCUMENTS

CN 1865700 A 11/2006
CN 101000048 A 7/2007

(Continued)

OTHER PUBLICATIONS

Li Jingui, "Design Manual of Modern Surface Engineering", Nat'l Defence Industry Press, Set, Sep. 30, 2000, ISBN 7-118-02332-9.

*Primary Examiner* — Peter J Bertheaud
(74) *Attorney, Agent, or Firm* — Michael W. Haas

(57) ABSTRACT

A compressor assembly (10) configured to increase pressure of a fluid. The compressor assembly includes a cylinder (12*a*, 12*b*) forming a space for compressing the fluid and a piston (14*a*, 14*b*) configured to reciprocate in the cylinder to compress the fluid. The compressor assembly includes a crank shaft (72) configured to drive the piston and a crank shaft housing (18*a*, 18*b*) operatively connected to the cylinder and configured to house the crank shaft. A motor (20) is connected to the crank shaft and drives the crank shaft. The compressor assembly further includes a motor housing (22) connected to the crank shaft housing and configured to house the motor. A thermal insulator (24*a*, 24*b*) is disposed between the motor housing and the crank shaft housing to enhance thermal insulation between the motor housing and the crank shaft housing.

19 Claims, 7 Drawing Sheets

(52) U.S. Cl.
CPC ..... *F04B 39/12* (2013.01); *F04B 39/121* (2013.01); *F04B 53/08* (2013.01); *F04B 2201/0801* (2013.01); *Y10T 29/49236* (2015.01)

(56) References Cited

U.S. PATENT DOCUMENTS

| | | | | |
|---|---|---|---|---|
| 2006/0275160 | A1 | 12/2006 | Leu | |
| 2009/0104052 | A1* | 4/2009 | Leu | F04B 35/04 417/338 |

FOREIGN PATENT DOCUMENTS

| | | | |
|---|---|---|---|
| CN | 101133247 | A | 2/2008 |
| CN | 201218198 | Y | 4/2009 |
| EP | 806503 | A1 | 11/2007 |
| JP | 2008215325 | A | 9/2008 |
| JP | 2010106819 | A | 5/2010 |
| WO | W09927232 | A1 | 6/1999 |
| WO | WO2006069881 | A1 | 7/2006 |

* cited by examiner

ELECTRIC MOTOR THERMAL ENERGY ISOLATION

CROSS-REFERENCE TO RELATED APPLICATIONS

This patent application claims the priority benefit under 35 U.S.C. §371 of international patent application no. PCT/IB2011/053679, filed Aug. 22, 2011, which claims the priority benefit under 35 U.S.C. §119(e) of U.S. Provisional Application No. 61/377,607 filed on Aug. 27, 2010, the contents of which are herein incorporated by reference.

BACKGROUND OF THE INVENTION

1. Field of the Invention

The invention relates to a compressor, and, in particular, to a compressor having improved thermal handling characteristics.

2. Description of the Related Art

A compressor receives a supply of fluid, such as a liquid or gas, at a first pressure and increases the pressure of the fluid by forcing a given quantity of the received fluid from a first volume into a smaller second volume using a piston assembly. Some compressors have a reciprocating piston that reciprocates within the cylinder to compress the fluid. The pistons may be connected to a crank shaft housed in a crankcase. The crankshaft may be operated by a motor housed in a motor housing. A typical piston assembly includes a cup seal to provide a seal between the pressurized and non-pressurized sides of the piston. The cup seal flexes during movement of the piston within the cylinder and the frictional engagement creates wear along the cup seal. The pressurization of gas on the pressurized side of the piston, the frictional engagement of the cup seal with the cylinder, and/or other operating conditions generate heat to which the cup seal is exposed. This heat further hastens failure of the flexible cup seal, thus limiting the life of the compressor.

In some compressors, heat may be dissipated from the cup seal using a crankcase that is directly coupled to the cylinder. Because of its mass, the crankcase may be intended to function as a heat sink to conduct the heat from the cylinder and the cup seal. Subsequently, a fan may provide air convection to dissipate the heat away from the crankcase.

However, in compressors where the motor housing is directly coupled to the crankcase, heat may be simultaneously conducted from the motor to the crankcase when heat is conducted from the cup seal and the cylinder to the crankcase. This is problematic when the thermal heat from the motor exceeds the heat being generated at or within the cylinder. In such situations, the heat from the motor may be indirectly conducted to the cylinder and the cup seal, thus ultimately increasing the heat on the cylinder and cup seal rather than decreasing it. Accordingly, further steps must be taken to remove heat from the cylinder/crankcase/motor housing system. For example, a larger fan may be used to provide higher CFM (cubic feet per minute) of air to convect the heat However, this may cause the device that includes such compressor and fan to be larger and bulkier. Alternatively or additionally, a larger crankcase may be used. However, this may cause the compressor to be bulkier, more expensive to manufacture, and inefficient.

SUMMARY OF THE INVENTION

Accordingly, it is an object of the present invention to provide a compressor assembly that overcomes the shortcomings of conventional compressor assembly. This object is achieved according to one embodiment of the present invention by providing a compressor assembly configured to increase pressure of a fluid that includes a cylinder forming a space for compressing the fluid and a piston configured to reciprocate in the cylinder so as to compress the fluid. The compressor assembly also includes a crank shaft configured to drive the piston and a crank shaft housing that is operatively connected to the cylinder and configured to house the crank shaft. A motor operatively is connected to the crank shaft and is configured to drive the crank shaft. The compressor assembly further includes a motor housing operatively connected to the crank shaft housing and configured to house the motor. A thermal insulator is disposed between the motor housing and the crank shaft housing to enhance thermal insulation between the motor housing and the crank shaft housing.

Another aspect of the invention relates to a method of assembling a compressor assembly that is configured to increase pressure of a fluid. The method includes obtaining a compressor assembly. The compressor assembly includes a cylinder having space for compressing the fluid. The compressor assembly also includes a piston, wherein the piston is configured to reciprocate in the cylinder so as to compress the fluid. The compressor assembly further includes a crank shaft that is configured to drive the piston and a crank shaft housing. The crank shaft housing houses the crank shaft and is connected to the cylinder. The compressor assembly further includes a motor that is configured to drive the crank shaft and a motor housing configured to house the motor in the motor housing. The method further includes coupling the motor housing to the crank shaft housing with a thermal insulator disposed therebetween to enhance thermal insulation between the motor housing and the crank shaft housing.

Another aspect of the invention relates to a compressor assembly configured to increase pressure of a fluid. The compressor assembly includes a cylinder coated with anodized metal material, the cylindrical cylinder having a mating portion and a main portion. The compressor assembly also includes a piston configured to reciprocate in the cylinder so as to compress the fluid and a crank shaft configured to drive the piston. A crank shaft housing is operatively connected to the cylinder and is configured to house the crank shaft. The compressor assembly also includes a motor operatively connected to the crank shaft and configured to drive the crank shaft. The mating portion of the cylindrical cylinder contacts the crank shaft housing. The anodized metal material of the mating portion is decreased or removed to facilitate thermal conduction between the cylinder and the crank shaft housing at the mating portion.

These and other objects, features, and characteristics of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment of the invention, the structural components illustrated herein are drawn to scale. It is to be expressly understood, however, that the drawings are for the purpose of illustration and description only and are not a limitation of the invention. In addition, it should be appreciated that structural features shown or described in any one embodiment herein can be used in other embodiments as well. It is to be expressly understood, however, that the drawings are for the purpose of illustration and description only and are not intended as a definition of the limits of the invention.

DETAILED DESCRIPTION OF THE EXEMPLARY EMBODIMENTS

Figure 1:
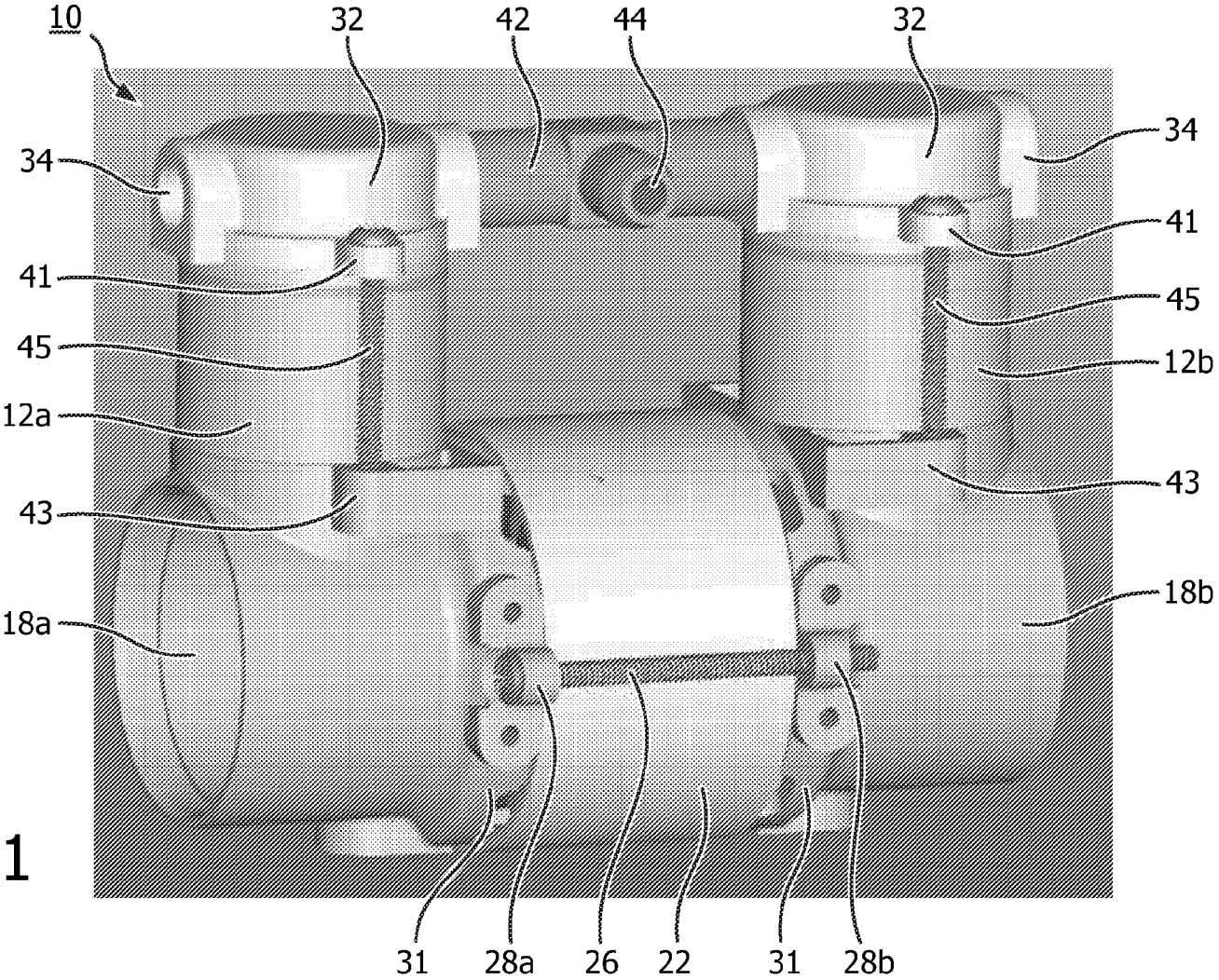
FIG. 1 is a perspective view of a compressor in accordance with an embodiment.

As used herein, the singular form of "a", "an", and "the" include plural references unless the context clearly dictates otherwise. As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other.

As used herein, the word "unitary" means a component is created as a single piece or unit. That is, a component that includes pieces that are created separately and then coupled together as a unit is not a "unitary" component or body. As employed herein, the statement that two or more parts or components "engage" one another shall mean that the parts exert a force against one another either directly or through one or more intermediate parts or components. As employed herein, the term "number" shall mean one or an integer greater than one (i.e., a plurality).

Directional phrases used herein, such as, for example and without limitation, top, bottom, left, right, upper, lower, front, back, and derivatives thereof, relate to the orientation of the elements shown in the drawings and are not limiting upon the claims unless expressly recited therein.

Figure 2:
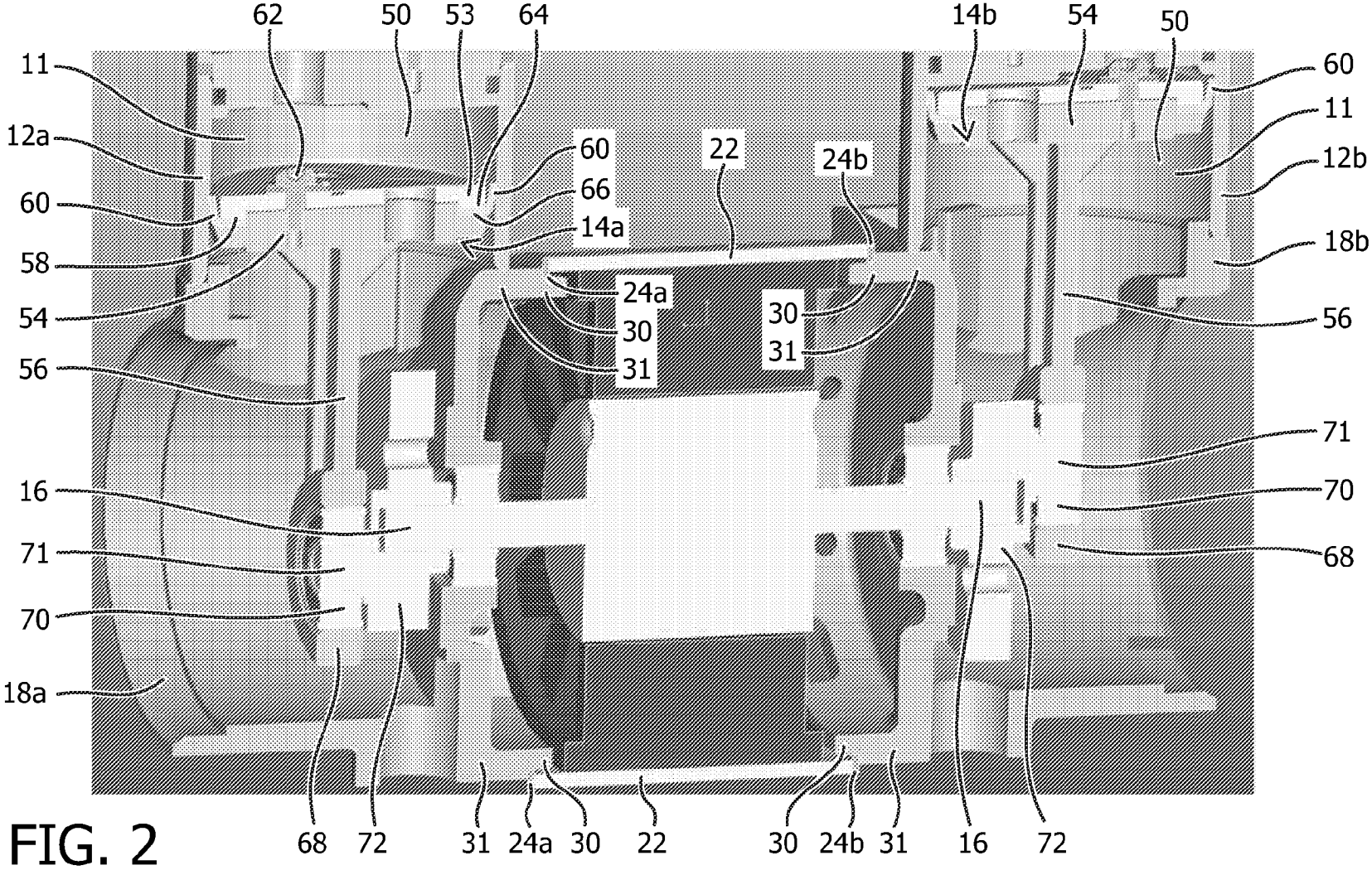
FIG. 2 is a cross sectional view of the compressor in accordance with an embodiment.

FIG. 1 illustrates a compressor assembly 10 having cylinders 12*a*, 12*b* (two are shown in this embodiment) for compressing a fluid, such as a liquid or gas. As shown in FIG. 2, pistons 14*a*, 14*b* are configured to reciprocate in cylinders 12*a*, 12*b*, respectively, so as to compress the fluid. Crank shafts 72 are configured to drive the pistons 14*a*, 14*b* within cylinders 12*a*, 12*b*. In this embodiment, pistons 14*a*, 14*b* are wobble (or WOB-L) pistons. However it is contemplated that other types of piston may be used in other embodiments. Crank shafts 72 are housed in crankcases or crank shaft housings 18*a*, 18*b* that are operatively connected to cylinders 12*a*, 12*b*. In this embodiment, two crankcases 18*a*, 18*b* are provided, each being associated with one of the cylinders 12*a*, 12*b*. A motor 20 is operatively connected to the crank shafts 72 and is configured to drive the crank shafts 72. The motor is housed in a motor housing 22 that is operatively connected to crankcases 18*a*, 18*b*. The thermal contact between motor housing 22 and crankcases 18*a*, 18*b* are minimized by thermal insulators 24*a*, 24*b* that are disposed between motor housing 22 and crankcases 18*a*, 18*b*.

In one embodiment, compressor assembly 10 has a tandem arrangement with two cylinders 12*a*, 12*b*, each having a piston 14*a*, 14*b* received therein. A motor shaft 16 connects the motor 20 to crankshafts 72, which are each connected to one of the two pistons 14*a*, 14*b*, so that the movement of the pistons 14*a*, 14*b* oppose each other. However, this embodiment is not intended to be limiting, and it is contemplated that the compressor assembly 10 may have other arrangements and numbers of cylinders 12*a*, 12*b*. For example, compressor assembly 10 may be of single or dual acting designs. Compressor assembly 10 may also include more than two cylinders.

In the embodiment shown in FIG. 2, cylinders 12*a*, 12*b* are coupled to the crankcases 18*a*, 18*b* and motor housing 22 is disposed between crankcases 18*a*, 18*b*. Each generally cylindrical crankcase 18*a*, 18*b* has an annular horizontally extending cylindrical flange 30 formed as a lateral extension that joins with the generally cylindrical motor housing 22. Cylindrical flange 30 extends from a side portion 31 of each crankcase 18*a*, 18*b*. Thermal insulators 24*a*, 24*b*, taking the form of rings in this embodiment, are disposed between motor housing 22 and the crank shaft housings 18*a*, 18*b* at an upper portion and a lower portion, respectively. In such configurations, at least portions of thermal insulators 24*a*, 24*b* may contact flanges 30 of crankcases 18*a*, 18*b*. For example, thermal insulators 24*a*, 24*b* may surround at least a portion of flanges 30. Thermal insulators 24*a*, 24*b* will be described in more detail later.

In the illustrated embodiment, cylinders 12*a*, 12*b* are directly coupled to crankcases 18*a*, 18*b*. Each cylinder 12*a*, 12*b* may include a main portion 15 (see FIG. 6) and a mating portion 17 (see FIG. 6). Mating portion 17 may be an annular portion of the cylinders 12*a*, 12*b* that contacts at least portions of crankcases 18*a*, 18*b* when cylinders 12*a*, 12*b* are coupled thereto.

Referring back to FIG. 1, a threaded member 26 (such as an elongated screw) may be used to hold cylinders 12*a*, 12*b* together, with motor housing 22 therebetween. Threaded member 26 may be received in receiving structures 28 extending from crankcases 18*a*, 18*b*. It is contemplated that bolts, pins, or other attachment mechanisms may be used in other embodiments.

As shown in FIG. 1, each cylinder 12*a*, 12*b* has a compressor head 32 operatively connected thereto. Each compressor head 32 has an extension 41 with an opening (not shown) formed therein. A screw 45 is configured to be inserted through the opening of each compressor head 32 and into an opening (not shown) formed in an extension 43 in each crankcase 18*a*, 18*b*. Accordingly, screws 32 secure the connection among compression heads 32, cylinders 12*a*, 12*b*, and crankcases 18*a*, 18*b*.

Figure 3:
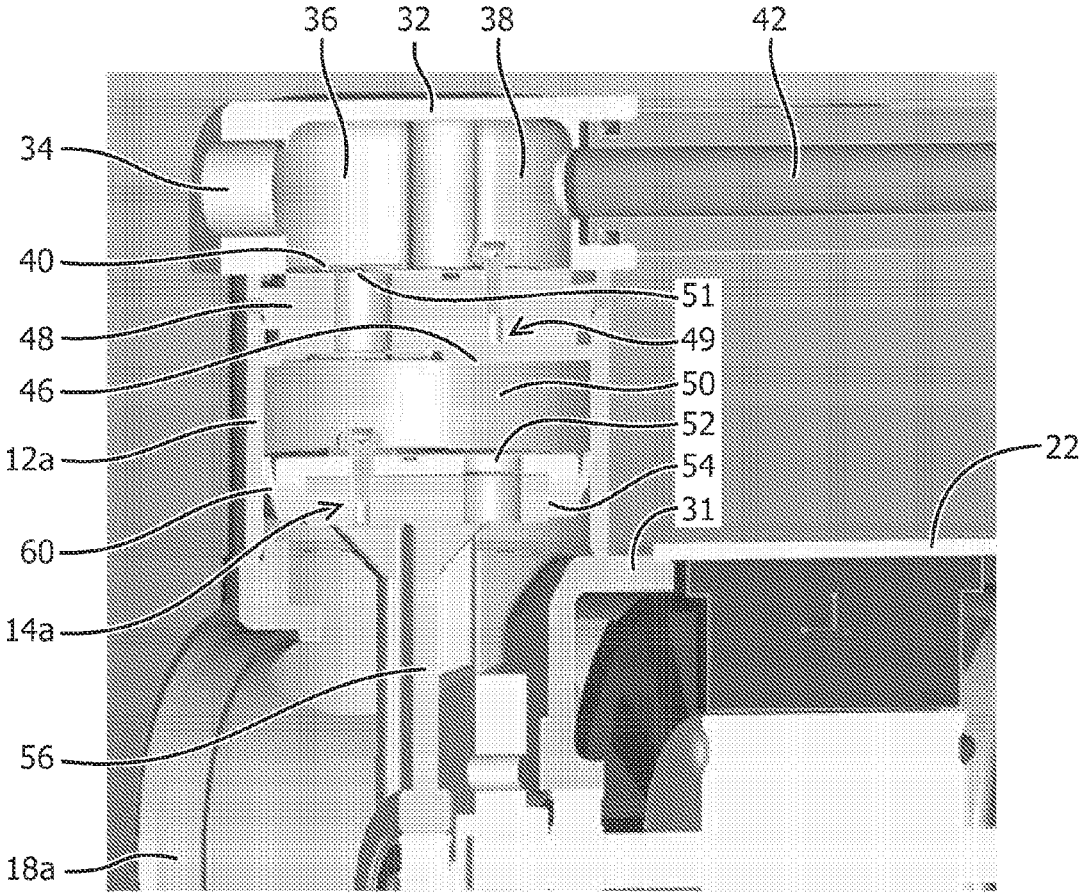
FIG. 3 is a detailed cross sectional view of a piston and a cylinder of the compressor in accordance with an embodiment.

As shown in FIG. 3, compressor head 32 has a gas intake port 34 formed therein. In the illustrated embodiment, a plate 49 is provided between compressor head 32 and the cylinder 12*a*. Above an upper portion 40 of the plate 49, compressor head 32 includes an internal chamber 36 that communicates with gas intake port 34 and an internal exhaust chamber 38 that communicates with an exhaust port 42. As shown in FIG. 1, exhaust port 42 is connected to both compression heads 32 and provides a common outlet 44 for fluids from both compressor heads 32. Referring back to FIG. 3, a lower portion 46 of plate 49 is provided below the upper portion 40 so as to define a middle portion 48 between lower portion 46 and upper portion 40. Valves may be provided such that fluids may travel between chambers 36, 38 in compressor head 32 and a first interior space 50 in cylinder 12.

In this embodiment, an input valve 52 enables fluid to be drawn through intake port 34 to the first interior space 50 when pistons 14*a*, 14*b* tilt within the cylinders 12*a*, 12*b*. An output valve 51 may be provided in the middle portion 48 to enable fluids to travel through first interior space 50 to exhaust port 42. Input valve 52 may be constructed and arranged such that input valve 52 allows air through only when pistons 14*a*, 14*b* are moving downwards. Output valve 51 may be constructed and arranged such that output valve 51 allows air through only when pistons 14*a*, 14*b* are moving upwards. Cylinder 12*b* may have a similar configuration as cylinder 12*a*.

As shown in FIG. 2, each piston 14*a*, 14*b* includes a head portion 54 and a rod portion 56. First interior space 50 of cylinders 12*a*, 12*b* may be defined by an inner surface 11 of the cylinders and head portion 54 of the pistons. In this embodiment, head portion 54 and rod portion 56 are integral, although they may be separate in other embodiments. Head portion 54 and rod portion 56 may be cast from a strong light weight material such as aluminum alloy. A cap 53 may be operatively connected to the head portion 54. Head portion 54 has a generally flat circular configuration with an annular groove 58 defined by a top edge 66 of the head portion 54 and a radially outer bottom portion 64 of the cap 53 for receiving a cup seal 60.

As mentioned above, cup seal 60 is configured to provide a seal between the pressurized and non-pressurized sides of the pistons 14*a*, 14*b*. That is, cup seal 60 may have an outward bias relative to head portion 54 such that it compressively engages inner walls 13*a*, 13*b* of cylinders 12*a*, 12*b*, respectively, throughout the pistons' 14*a*, 14*b* strokes, thereby preventing fluid from escaping from the upper interior space 50. Cup seal 60 may adopt an upwardly flexed position with respect to inner surface 11 of cylinders 12*a*, 12*b*. A screw 62 may be used to secure cap 53 to head portion 54 of piston 14*a*, 14*b*, thereby also retaining cup seal 60 within groove 58.

In the illustrated embodiment, rod portion 56 of pistons 14*a*, 14*b* has a lower end 68 with a bearing 70. Each bearing 70 has a center 71 that is configured to receive a portion of the crank shaft 72. Eccentric crank shafts 72 are connected to motor shaft 16 such that the axis defined by the motor shaft is offset from the axis defined by center 71 of bearings 70. Thus, motor shaft 16 and pistons 14*a*, 14*b* are configured to be eccentric. As such, as the motor shaft rotates crankshafts 72, pistons 14*a*, 14*b*, which ride on the bearings 70, reciprocates upwardly and downwardly within the cylinders 12*a*, 12*b*. This configuration enables pistons 14*a*, 14*b* to tilt relative to cylinders 12*a*, 12*b* at all positions (except when pistons 14*a*, 14*b* are at the top most and bottom most positions) due to the eccentricity of crank shafts 72. It is contemplated the crank shafts do not need to be eccentric and may have other configurations or arrangements. As an exemplary reference, piston 14*a* shown in FIG. 2 is in the bottom most position and piston 14*b* shown in FIG. 2 is in the top most position. This configuration of pistons 14*a*, 14*b* and crankshafts 72 converts the rotary energy from motor 20 into linear motion of pistons 14*a*, 14*b* within cylinders 12*a*, 12*b*.

As mentioned above, the movement of pistons 14*a*, 14*b* within cylinders 12*a*, 12*b* causes heat to increase on cup seals 60 and cylinders 12*a*, 12*b* due to the frictional engagement between the cup seals 60 and inner surface 11 of cylinders 12*a*, 12*b*, and/or due to the compression of fluid. Crankcases 18*a*, 18*b* may be used as a heat sink to conduct the heat from cylinders 12*a*, 12*b* and cup seals 60. A cooling fan (not shown) may be provided to generate cooling current for convecting heat away from compressor assembly 10.

Figure 4:
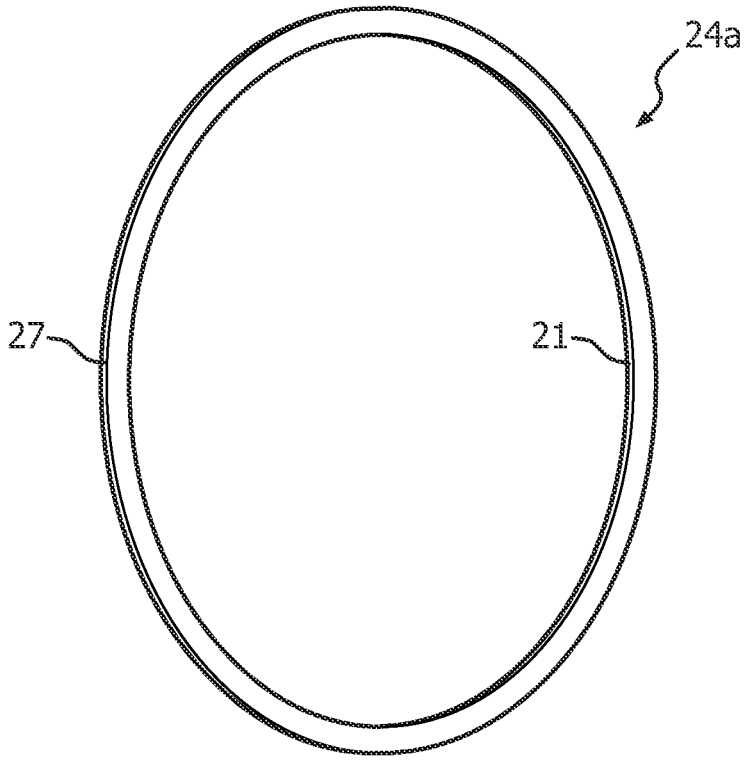
FIG. 4 is a perspective view of a thermal insulator of the compressor in accordance with an embodiment.
Figure 7A:
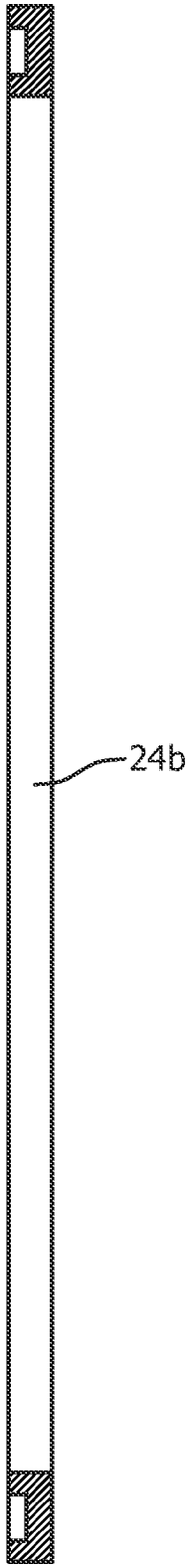
FIG. 7*a* is a cross sectional view of the insulator ring in accordance with an embodiment.
Figure 7B:
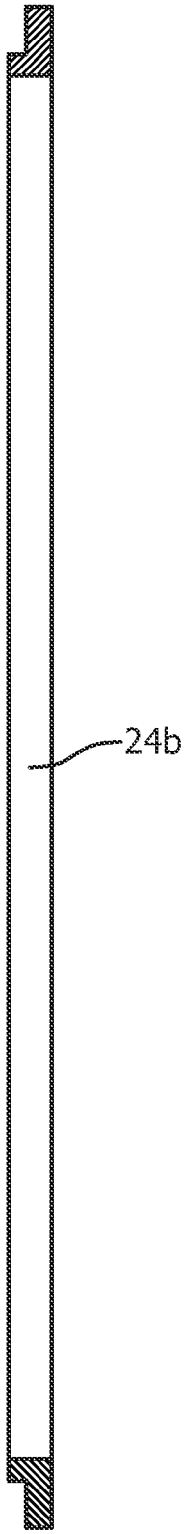
FIG. 7*b* is a cross sectional view of the insulator ring in accordance with another embodiment.

In the embodiment shown in FIG. 2, instead of directly coupling motor housing 22 to crankcases 18*a*, 18*b*, upper and lower thermal insulators 24*a*, 24*b* are provided between motor housing 22 and crankcases 18*a*, 18*b* to enhance the thermal isolation between them. In the embodiment shown in FIG. 4, thermal insulator 24*a* takes the shape of a ring having an inner surface 21 and an outer surface 25. Thermal insulator 24*b* may have a similar size and configuration as thermal insulator 24*a*. Thermal insulators 24*a*, 24*b* may have various cross sections. For example, in one embodiment, thermal insulators 24*a*, 24*b* may have a U-shaped cross section as shown in FIG. 7*a*. In such embodiment, the U-shaped cross section may be defined by a top surface 29 (see FIG. 5*a*), a middle surface 33 (see FIG. 5*a*), and a bottom surface 35 (see FIG. 5*a*). Alternatively, thermal insulators 24*a*, 24*b* may have an L-shaped cross section as shown in FIG. 7*b*. In such embodiment, L-shaped cross section may be defined by the middle surface 33 (see FIG. 5*b*) and the bottom surface 35 (see FIG. 5*b*). However, it is contemplated that thermal insulators 24*a*, 24*b* may have any cross-section and are not limited to the examples shown in these Figures.

Thermal insulators 24*a*, 24*b* may have any configuration that enables thermal insulators 24*a*, 24*b* to enhance thermal isolation between crankcases 18*a* and motor housing 22. The size and thickness of thermal insulators 24*a*, 24*b* may depend on the configuration and arrangement of crankcases 18*a*, 18*b* and motor housing 22. For example, as mentioned above and as shown in FIG. 2, each generally cylindrical crankcase 18*a*, 18*b* has the annular horizontally extending cylindrical flange 30 formed as a lateral extension that joins with motor housing 22. Alternatively or additionally, cylindrical crankcases 18*a*, 18*b* may have other structures configured to join crankcases 18*b* with motor housing 22.

Figure 5A:
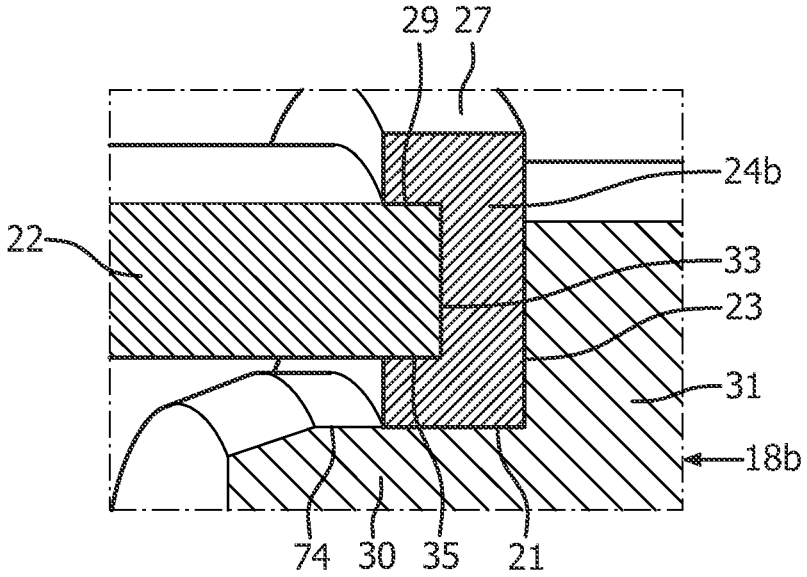
FIG. 5*a* is a cross sectional detailed view of the insulator ring disposed between a crankcase and a motor housing of the compressor in accordance with an embodiment.
Figure 5B:
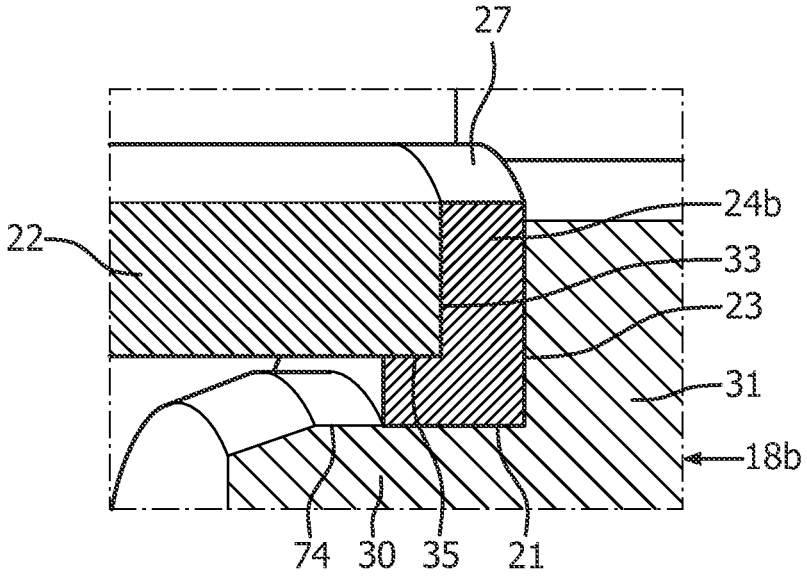
FIG. 5*b* is a cross sectional detailed view of the insulator ring disposed between a crankcase and a motor housing of the compressor in accordance with another embodiment.

Referring back to the embodiment shown in FIG. 2, flange 30 has a smaller circumference than side portion 31 of each crankcase 18*a*, 18*b*, and thus, at least portions of flange 30 are disposed within motor housing 22. Thermal insulators 24*a*, 24*b* may be configured to be disposed on flanges 30 such that the thermal insulators form a periphery around flanges 30 of crankcases 18*a*, 18*b*, respectively. FIGS. 5*a*-5*b* show the arrangement of thermal insulator 24*b* positioned on crankcase 18*b*. Thermal insulator 24*a* may be positioned on the crankcase 18*a* as a mirror image of thermal insulator 24*b*.

As shown in FIG. 5*a*, flange 30 and side portion 31 of crankcase 18*b* define an annular ledge 74 formed on an outer surface of the flange 30. The difference in circumference between flange 30 and side portion 31 also defines a vertical peripheral surface 23. In the illustrated embodiment, at least portions of inner surface 21 of thermal insulator 24*b* are constructed and arranged to be disposed on ledge 74. In this embodiment, thermal insulator 24*b* is configured such that when the thermal insulator is disposed on the ledge, the thermal insulator extends above side portions 31 of crankcase 18*b* and at least portion of thermal insulator 24*b* may be configured to contact the vertical peripheral surface 23 of crankcase 18*b*. In this embodiment, at least portions of motor housing 22 is received in the U-shaped portion of thermal insulator 24*b* that is defined by top surface 29, middle surface 33, and bottom surface 35 of the thermal insulator 24*b*. Thus, in this embodiment, motor housing 22 contacts top surface 29, middle surface 33, and bottom surface 35 of thermal insulator 24*b*.

In the embodiment shown in FIG. 5*b*, thermal insulator 24*b* is arranged on crankcase 18*b* in a similar manner as the embodiment shown in FIG. 5*a*. However, in this embodiment, motor housing 22 is received on the L-shaped portion of the thermal insulator 24*b* defined by middle surface 33 and bottom surface 35 of thermal insulator 24*b*. Thus, in this embodiment, motor housing 22 contacts both middle surface 33 and bottom surface 35 of thermal insulator 24*b*. It is contemplated that motor housing 22 may contact any combination or all of surfaces 29, 33, 35 of the various embodiments of thermal insulators 24*a*, 24*b*. Accordingly, thermal insulator 24*b* prevents the motor housing 22 from contacting ledge 74 or other parts of crankcase 18*b* directly.

Thermal insulator 24*a* may be configured to be disposed between crankcase 18*a* and motor housing 22 in a similar manner. Thermal insulator 24*a* may also be configured to contact motor housing 22 in a similar manner as either of the two embodiments of thermal insulator 24*b* shown in FIGS. 5*a*-5*b*. Thermal insulator 24*a* may be constructed and arranged in a similar manner as thermal insulator 24*b*. However, the size and configuration of thermal insulators 24*a*, 24*b* may be varied in other embodiments to achieve the optimal performance for thermal isolation. In the embodiment of FIG. 2, thermal insulator 24*a* is arranged between crankcase 18*a* and motor housing 22 such that thermal insulator 24*a* is a mirror image of thermal insulator 24*b* arranged between crankcase 18*b* and motor housing 22.

Thermal insulators 24*a*, 24*b* may be manufactured and/or assembled with compressor assembly 10. In some embodiments, thermal insulators 24*a*, 24*b* may be retrofit into existing compressor assemblies 10. That is, compressor assemblies 10 may already be manufactured and assembled without thermal insulators 24*a*, 24*b*. In such embodiments, thermal insulators 24*a*, 24*b* may be added to compressor assemblies 10 at the points of contact between crankcases 18*a*, 18*b* and motor housing 22 to enhance thermal isolation therebetween.

Thermal insulators 24*a*, 24*b* may be made of stainless steel, such as those having a conductivity of about 15 W/(m*K) (Watts per meter-Kelvin). The stainless steel may have wear resistant properties, low creep, and may be constructed at a low cost. Other materials may also be used, such as, just for example, glass filed nylon (e.g., 30% glass filled Nylon 66 having a conductivity of 0.27 W/(m*K)), Telfon®, ceramics having properties of low creep and low conductivity, plastics having low thermal conductivity and low creep, and/or other materials with low thermal conductivity and low creep. Crankcases 18*a*, 18*b* may be made of aluminum, such as those having a conductivity between 100 and 200 W/(m*K)) or other materials. Motor housing 22 may be made of aluminum or other materials. Cylinders 12*a*, 12*b* may also be made of aluminum, or may be made of other materials. In one embodiment, cylinders 12*a*, 12*b* are made of aluminum having a grade of AL6061 with a conductivity of about 170 W/(m*K). The cylinders may have an anodized coating to improve the properties thereof, such as to increase its corrosion resistance and wear resistance. However, the anodized coating in such embodiments may cause the conductivity of cylinders 12*a*, 12*b* to decrease. In some embodiments, the conductivity may be decreased to, just for example, 30-35 W/(m*K). As such, the effectiveness of the heat dissipation from the cylinders 12*a*, 12*b* to crankcases 18*a*, 18*b* are also decreased.

The lowered conductivity may be problematic when crankcases 18*a*, 18*b* function as heat sinks for cylinders 12*a*, 12*b*. That is, lowered conductivity due to anodized coatings may impede the flow to crankcases 18*a*, 18*b* of heat generated in cylinders 12*a*, 12*b* by the frictional engagement between cup seal 60 and inner surface 11 of cylinders 12*a*, 12*b* and/or by the compression of fluids.

The following description of crankcase 18*a* and cylinder 12*a* may also be applicable to crankcase 18*b* and cylinder 12*b*. In the embodiment shown in FIG. 6, crankcase 18*a* has a vertically extending flange 76 formed as a vertical extension extending from an outer portion 78 of the crankcase. Flange 76 is offset from the outer portion 78. Thus, flange 76 and outer portion 78 define a ledge 80 located on a top surface of outer portion 78 of crankcase 18*a*. In the illustrated embodiment, mating portion 17 of cylinder 12*a* is constructed and arranged to be disposed on ledge 80. Mating portion 17 may also be constructed and arranged to contact the flange 76 at an outer surface 82 of flange 76. Thus, the contact between mating portion 17 of cylinder 12*a* and outer surface 82 of flange 76 and the contact between mating portion 17 of cylinder 12*a* and ledge 80 of crankcase 18*a* dissipates the heat from cylinder 12*a* to crankcase 18*a*. However, as mentioned above, the anodized coating of cylinders 12*a* may impede the conduction of the heat from cylinder 12*a* to crankcase 18*a*.

Figure 6:
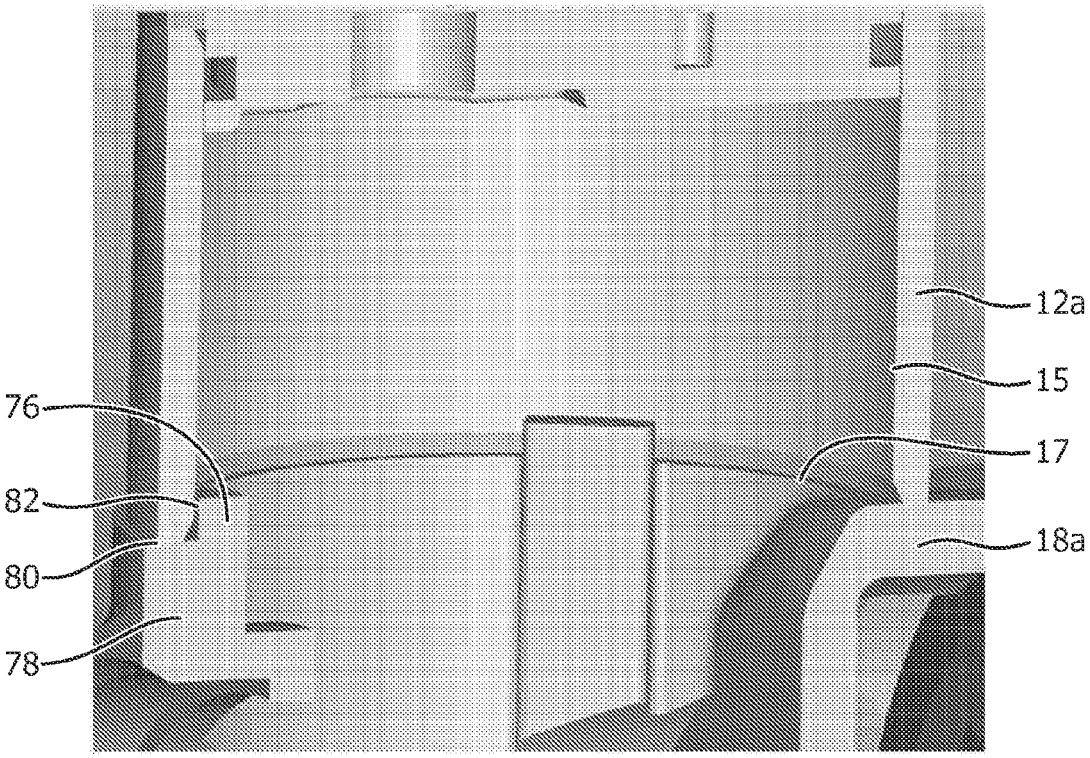
FIG. 6 is a cross sectional detailed view of the cylinder and the crankcase of the compressor in accordance with an embodiment.

To combat this, in the embodiment of FIG. 6, mating portion 17 is ground or polished to decrease the anodized coating thereon such that the conductivity of the mating portion may be increased. By grounding/polishing mating portion 17, the thickness of the anodized coating on the mating portion is decreased such that the anodized coating on the mating portion is thinner than the anodized coating on main portion 15. Mating portion 17 may be beveled due to the grounding thereof. Any tools or methods may be used to grind the anodized coating from mating portion 17. It is also contemplated that any abrasive material may be used to remove the anodized coating on mating portion 17. In some embodiments, main portion 15 may have anodized coating having a thickness of 0.001 inches. In some embodiments, the anodized coating may be completely removed from mating portion 17. In one embodiment, rather than grinding down an existing anodized coating, a coating of a lesser thickness (or no coating at all) may be formed on mating portion 17 separate from the coating formed on main portion 15.

Mating portion 17 may be configured to include any portion of cylinder 12*a* that contacts crankcase 18*a*. Mating portion 17 may be the portion of cylinder 12*a* that contacts or mates with crankcase 18*a*, or may optionally be larger such that only a portion of mating portion 17 contacts crankcase 18*a*. Main portion 15 of cylinder 12*a* may be the rest of cylinder 12*a* (or any portion of cylinder 12*a* that is not mating portion 17). Cylinder 12*b* may have a similar configuration as cylinder 12*a*.

Compressor assembly 10 may operate as follows in accordance with an embodiment. In one embodiment, motor 20 rotates crankshaft 72 via motor shaft 16 to operate piston 14*a*. As piston 14*a* travels from the top most position to the tilted position (not shown), the suction created within its associated cylinder 12*a* causes fluid to travel from the chamber 36 into its associated cylinder 12*a* through input valve 52. Cup seal 60 may adopt an upwardly flexed position where it engages interior surface 11 of cylinder 12*a* when piston 14*a* is moving downwards towards the bottom most position.

After piston 14*a* has reached the bottom most position, the piston then moves upwards to a tilted position, thereby compressing the fluid in its associated cylinder 12*a*. Cup seal 60 may optionally adopt a downwardly flexed position where it engages with inner surface 11 of cylinder 12*a* when piston 14*a* is moving upwards. The upward motion of piston 14*a*, 14*b* causes output valve 51 to open, thereby allowing the fluid to travel to internal exhaust chamber 38 and to exhaust port 42. The other piston 14*b* functions in an opposing way. Thus, when piston 14*a* moves from the down most position towards the top most position, piston 14*b* moves from the top most position to the down most position. During the movement of pistons 14*a*, 14*b* within cylinders 12*a*, 12*b*, the heat generated by the frictional engagement between cup seals 60 and inner surfaces 11 of cylinders 12*a*, 12*b* and/or by the compression of fluid is conducted from cylinders 12*a*, 12*b* to crankcases 18*a*, 18*b*. Heat is conducted from cylinders 12*a*, 12*b* to crankcases 18*a*, 18*b* via mating portions 17 of the cylinders that have been ground to decrease the anodized coatings thereon. In addition, as motor 20 rotates crankshaft 72 to move pistons 14*a*, 14*b*, heat is generated by motor 20. Thermal insulators 24*a*, 24*b* thermally isolate motor housing 22 to decrease the amount of heat conducted from motor housing 22 to crankcases 18*a*, 18*b*. Thus, heat dissipation may be enhanced in compressor assembly 10 by the use of thermal insulators 24*a*, 24*b* and/or by grounding portions of cylinders 12*a*, 12*b* (i.e., mating portion 17) to decrease or remove the anodized coating thereon.

Although a compressor assembly 10 is described above, it is contemplated thermal insulator 60 may be used with other devices such as, just for example, gear motors, pumps, and blowers, or any device that has a motor that is mechanically coupled to other components. By thermally isolating the motor from other components, the performance and efficiency of the devices would be improved. Furthermore, the thermal insulators may also help reduce the size of the fan required to cool the device, thus reducing the costs associated with the device.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A compressor assembly configured to increase pressure of a fluid, the compressor assembly comprising:

a first cylinder forming a first space for compressing the fluid;

a second cylinder forming a second space for compressing the fluid;

a first piston configured to reciprocate in the first cylinder so as to cause a first cup seal to compress the fluid;

a second piston configured to reciprocate in the second cylinder so as to cause a second cup seal to compress the fluid;

a first crank shaft configured to drive the first piston;

a second crank shaft configured to drive the second piston;

a first crank shaft housing operatively connected to the first cylinder and configured to house the first crank shaft;

a second crank shaft housing operatively connected to the second cylinder and configured to house the second crank shaft;

a motor operatively connected to the first crank shaft and the second crank shaft and configured to drive the first crank shaft and the second crank shaft;

a motor housing operatively connected to the first crank shaft housing and the second crank shaft housing and configured to house the motor, the motor housing comprising a tube with a first end and a second end, the motor housing open at the first end and the second end, the first end coupled to the first crank shaft housing and the second end coupled to the second crank shaft housing;

a first thermal insulator disposed between the first end of the motor housing and the first crank shaft housing to enhance thermal insulation between the first end of the motor housing and the first crank shaft housing and reduce or prevent heat transfer from the motor housing through the first crank shaft housing and the first cylinder to the first cup seal, wherein the first thermal insulator is disposed such that the first thermal insulator follows a periphery of a flange of the first crank shaft housing; and a second thermal insulator disposed between the second end of the motor housing and the second crank shaft housing to enhance thermal insulation between the second end of the motor housing and the second crank shaft housing and reduce or prevent heat transfer from the motor housing through the second crank shaft housing and the second cylinder to the second cup seal, wherein the second thermal insulator is disposed such that the second thermal insulator follows a periphery of a flange of the second crank shaft housing.

2. The compressor assembly of claim 1, wherein the first thermal insulator and the second thermal insulator take the form of a ring.

3. The compressor assembly of claim 1, wherein the first thermal insulator and the second thermal insulator comprise stainless steel, plastic, or glass filled nylon.

4. The compressor assembly of claim 1, wherein the first thermal insulator and the second thermal insulator have a cross sectional shape including a U-shaped cross section or an L-shaped cross section.

5. The compressor assembly of claim 4, wherein the first thermal insulator has the U-shaped cross section, and the first insulator is disposed such that a first inner surface of the first thermal insulator, a second inner surface of the first thermal insulator, and a third inner surface of the first thermal insulator engages with the motor housing.

6. The compressor assembly of claim 4, wherein the first thermal insulator has the L-shaped cross section, and the first insulator is disposed such that a first inner surface of the first thermal insulator and a second inner surface of the first thermal insulator engages with the motor housing.

7. The compressor assembly of claim 1, wherein the second thermal insulator is the same as or similar to the first thermal insulator in size, shape, or configuration.

8. The compressor assembly of claim 1, wherein the first thermal insulator has a size and thickness approximately following the circumference of the first crank shaft housing at a portion of the first crank shaft housing that engages with the motor housing such that the cross sectional shape, diameter, and size of the first thermal insulator corresponds to the cross sectional shape, diameter, and size of the first crank shaft housing or the motor housing; and the second thermal insulator has a size and thickness approximately following the circumference of the second crank shaft housing at a portion of the second crank shaft housing that engages with the motor housing such that the cross sectional shape, diameter, and size of the second thermal insulator corresponds to the cross sectional shape, diameter, and size of the second crank shaft housing or the motor housing.

9. The compressor assembly of claim 1, wherein the first thermal insulator is configured such that at least a portion of an inner surface of the first thermal insulator is disposed on a ledge formed on an outer surface of the flange, wherein the first thermal insulator prevents the motor housing from directly contacting the ledge of the first crank shaft housing, and the second thermal insulator configured such that at least a portion of an inner surface of the second thermal insulator is disposed on a ledge formed on an outer surface of the flange, wherein the second thermal insulator prevents the motor housing from directly contacting the ledge of the second crank shaft housing.

10. The compressor assembly of claim 1, wherein the flange of the first crank shaft housing has a smaller circumference than a side portion of the first crank shaft housing and the flange of the second crank shaft housing has a smaller circumference than a side portion of the second crank shaft housing wherein at least a portion of the flange of the first crank shaft housing and a portion of the flange of the second crank shaft housing is disposed within the motor housing.

11. The compressor assembly of claim 1, wherein one or both of the first thermal insulator or the second thermal insulator are configured to be retrofit into existing compressor assemblies such that the first the thermal insulator and the second thermal insulator are configured to be added between the motor housing and one or both of the first crank shaft housing or the second crank shaft housing to enhance thermal isolation of compressor assemblies manufactured without thermal insulators.

12. A method of assembling a compressor assembly that is configured to increase pressure of a fluid, the method comprising:

(a) obtaining a compressor assembly, the compressor assembly comprising:
- a first cylinder having a space for compressing the fluid;
- a second cylinder having a space for compressing the fluid;
- a first piston, wherein the first piston is configured to reciprocate in the first cylinder so as to cause a first cup seal to compress the fluid;
- a second piston, wherein the second piston is configured to reciprocate in the second cylinder so as to cause a second cup seal to compress the fluid;
- a first crank shaft that is configured to drive the first piston;
- a second crank shaft that is configured to drive the second piston;
- a first crank shaft housing configured to house the first crank shaft in the first crank shaft housing, the first crank shaft housing being connected to the first cylinder;
- a second crank shaft housing configured to house the second crank shaft in the second crank shaft housing, the second crank shaft housing being connected to the second cylinder;
- a motor that is configured to drive the first crank shaft and the second crank shaft; and
- a motor housing configured to house the motor in the motor housing, the motor housing comprising a tube having a first end and a second end, the motor housing open at the first end and the second end;

(b) coupling the first end of the motor housing to the first crank shaft housing with a first thermal insulator disposed there between to enhance thermal insulation between the motor housing and the first crank shaft housing and reduce or prevent heat transfer from the motor housing through the first crank shaft housing and the first cylinder to the first cup seal, wherein the first thermal insulator is disposed such that the first thermal insulator follows a periphery of a flange of the first crank shaft housing; and (c) coupling the second end of the motor housing to the second crank shaft housing with a second thermal insulator disposed there between to enhance thermal insulation between the motor housing and the second crank shaft housing and reduce or prevent heat transfer from the motor housing through the second crank shaft housing and the second cylinder to the second cup seal, wherein the second thermal insulator is disposed such that the second thermal insulator follows a periphery of a flange of the second crank shaft housing.

13. The method of claim 12, wherein coupling the first end of the motor housing with the first crank shaft housing comprises retrofitting the first end of the motor housing and the first crank shaft housing with the first thermal insulator, and wherein coupling the second end of the motor housing with the second crank shaft housing comprises retrofitting the second end of the motor housing and the second crank shaft housing with the second thermal insulator.

14. The method of claim 12, wherein the first thermal insulator and the second thermal insulator comprise stainless steel, plastic, or glass filled nylon.

15. The method of claim 12, wherein the first thermal insulator and the second thermal insulator take the form of a ring.

16. A compressor assembly configured to increase pressure of a fluid, the compressor assembly comprising:
- a first cylinder coated with anodized metal material, the first cylinder comprising a first main portion and a first mating portion;
- a second cylinder coated with anodized metal material, the second cylinder comprising a second main portion and a second mating portion;
- a first piston configured to reciprocate in the first cylinder so as to compress the fluid;
- a second piston configured to reciprocate in the second cylinder so as to compress the fluid;
- a first crank shaft configured to drive the first piston;
- a second crank shaft configured to drive the second piston;
- a first crank shaft housing operatively connected to the first cylinder and configured to house the first crank shaft;
- a second crank shaft housing operatively connected to the second cylinder and configured to house the second crank shaft; and
- a motor operatively connected to the first crank shaft and the second crank shaft and configured to drive the first crank shaft and the second crank shaft, wherein the first mating portion of the first cylinder contacts the first crank shaft housing and the second mating portion of the second cylinder contacts the second crank shaft housing, and wherein the anodized metal material of the first mating portion and the second mating portion is decreased relative to the anodized metal material of the first main portion and the second main portion, but not eliminated, to enhance thermal conduction between the first cylinder and the first crank shaft housing at the first mating portion, and the second cylinder and the second crank shaft housing at the second mating portion;
- a motor housing configured to house the motor in the motor housing, the motor housing comprising a tube having a first end and a second end, the motor housing open at the first end and the second end;
- a first thermal insulator disposed between the first end of the motor housing and the first crank shaft housing to enhance thermal insulation between the first end of the motor housing and the first crank shaft housing and reduce or prevent heat transfer from the motor housing through the first crank shaft housing and the first cylinder to a first cup seal created by the first piston, wherein the first thermal insulator is disposed such that the first thermal insulator follows a periphery of a flange of the first crank shaft housing; and a second thermal insulator disposed between the second end of the motor housing and the second crank shaft housing to enhance thermal insulation between the second end of the motor housing and the second crank shaft housing and reduce or prevent heat transfer from the motor housing through the second crank shaft housing and the second cylinder to a second cup seal created by the second piston, wherein the second thermal insulator is disposed such that the second thermal insulator follows a periphery of a flange of the second crank shaft housing.

17. The compressor assembly of claim 16, wherein the anodized metal material comprises aluminum.

18. The compressor assembly of claim 16, wherein the first mating portion and the second mating portion are ground to decrease the anodized metal material.

19. The compressor assembly of claim 16, wherein the first crank shaft housing and the second crank shaft housing comprise aluminum.

* * * * *